US008876488B2

(12) United States Patent
Fong

(10) Patent No.: US 8,876,488 B2
(45) Date of Patent: Nov. 4, 2014

(54) POSITIVE AIR SHUT OFF DEVICE FOR BAG-IN-BOX PUMP

(71) Applicant: Flow Control LLC, Beverly, MA (US)

(72) Inventor: John J. Fong, Irvine, CA (US)

(73) Assignee: Xylem IP Holdings LLC

( * ) Notice: Subject to any disclaimer, the term of this patent is extended or adjusted under 35 U.S.C. 154(b) by 90 days.

(21) Appl. No.: 13/747,229

(22) Filed: Jan. 22, 2013

(65) Prior Publication Data

US 2014/0034161 A1 Feb. 6, 2014

Related U.S. Application Data

(63) Continuation of application No. 12/407,986, filed on Mar. 20, 2009, now abandoned.

(51) Int. Cl.
*F04B 49/00* (2006.01)
*B67D 1/00* (2006.01)
*B67D 1/12* (2006.01)

(52) U.S. Cl.
CPC ..... *B67D 1/0027* (2013.01); *B67D 1/1243* (2013.01)
USPC ..... 417/46; 137/87.01; 222/66

(58) Field of Classification Search
CPC .... B67D 1/1243; B67D 1/103; F04B 49/022; F16K 31/003; F16K 31/365
USPC ..... 417/46, 384, 394; 222/63–66; 137/87.01; 251/75
See application file for complete search history.

(56) References Cited

U.S. PATENT DOCUMENTS

| | | | | |
|---|---|---|---|---|
| 1,681,490 | A | 8/1928 | Lomax | |
| 1,948,044 | A * | 2/1934 | Myers et al. | 137/87.01 |
| 2,832,370 | A | 4/1958 | Hill | |
| 3,152,604 | A | 10/1964 | Frye et al. | |
| 3,981,414 | A | 9/1976 | Gust et al. | |
| 4,014,461 | A | 3/1977 | Harvill | |
| 4,123,204 | A | 10/1978 | Scholle | |
| 4,169,489 | A | 10/1979 | Inada et al. | |
| 4,259,360 | A | 3/1981 | Venetucci et al. | |
| 4,275,823 | A | 6/1981 | Credle, Jr. | |
| 4,354,806 | A | 10/1982 | McMillin et al. | |
| 4,467,941 | A * | 8/1984 | Du | 222/1 |
| 4,540,349 | A * | 9/1985 | Du | 417/393 |

(Continued)

FOREIGN PATENT DOCUMENTS

| | | |
|---|---|---|
| EP | 0235437 | 9/1987 |
| EP | 0636407 | 2/1995 |
| WO | 2008005564 | 10/2008 |

*Primary Examiner* — Devon Kramer
*Assistant Examiner* — Joseph Herrmann

(57) ABSTRACT

The present invention provides a device for turning off a pump. In operation, when the device is activated there is vacuum pressure in a syrup chamber. A diaphragm acting in response to the vacuum causes a piston assembly in the syrup chamber to move in the one direction (e.g. right), thus compressing a W-shaped spring in the air chamber. As the piston assembly moves, a spring holder of the W-shaped spring also moves to the one direction. As the W-shaped spring is compressed over and passed the most compressed position, the W-shaped spring moves a valve assembly in the air chamber to an opposite direction (e.g. left) and blocks a hole in a spool that otherwise allows air to pass through the air chamber to activate the pump. When the air is stopped, this turns off the pump.

13 Claims, 3 Drawing Sheets

(56) References Cited

U.S. PATENT DOCUMENTS

| | | | | | |
|---|---|---|---|---|---|
| 4,544,328 | A | * | 10/1985 | Credle, Jr. | 417/33 |
| 4,610,192 | A | | 9/1986 | Hartley et al. | |
| 4,622,723 | A | | 11/1986 | Krauss | |
| 4,674,526 | A | | 6/1987 | Athanassiu | |
| 4,795,061 | A | | 1/1989 | Peckjian | |
| 4,957,220 | A | | 9/1990 | Du | |
| 5,021,219 | A | | 6/1991 | Rudick et al. | |
| 5,033,646 | A | | 7/1991 | McCann et al. | |
| 5,071,039 | A | | 12/1991 | Anglehart | |
| 5,125,541 | A | | 6/1992 | Anglehart | |
| 5,271,428 | A | * | 12/1993 | Dunn et al. | 137/509 |
| 5,341,957 | A | | 8/1994 | Sizemore | |
| 5,379,795 | A | | 1/1995 | Hartley et al. | |
| 5,445,186 | A | | 8/1995 | Richter et al. | |
| 5,450,882 | A | | 9/1995 | Cragun | |
| 5,470,209 | A | * | 11/1995 | Hartley et al. | 417/401 |
| 5,476,193 | A | | 12/1995 | Haynes | |
| 5,505,593 | A | * | 4/1996 | Hartley et al. | 417/393 |
| 5,558,506 | A | | 9/1996 | Simmons et al. | |
| 5,664,940 | A | | 9/1997 | Du | |
| 5,667,105 | A | | 9/1997 | Hartley et al. | |
| 5,833,439 | A | | 11/1998 | Du | |
| 6,026,850 | A | | 2/2000 | Newton et al. | |
| 6,267,268 | B1 | | 7/2001 | Quartarone et al. | |
| 6,374,852 | B1 | | 4/2002 | Olivas | |
| 6,685,443 | B2 | | 2/2004 | Simmons et al. | |
| 6,874,997 | B2 | | 4/2005 | Watanabe et al. | |
| 7,225,830 | B1 | | 6/2007 | Kershaw | |
| 2004/0206157 | A1 | | 10/2004 | Chen et al. | |
| 2004/0211322 | A1 | | 10/2004 | Halliday et al. | |
| 2005/0175750 | A1 | | 8/2005 | Sanders | |
| 2006/0254642 | A1 | | 11/2006 | Kshirsagar et al. | |

* cited by examiner

POSITIVE AIR SHUT OFF DEVICE FOR BAG-IN-BOX PUMP

CROSS-REFERENCE TO RELATED APPLICATION

This is a continuation application that claims benefit under 35 U.S.C. §120 to patent application Ser. No. 12/407,986, filed 20 Mar. 2009, which is hereby incorporated by reference in its entirety.

BACKGROUND OF THE INVENTION

1. Field of the Invention

The present invention relates to a technique for turning off a pump; and more particularly relates to a technique for turning off a pump that is providing syrup to a beverage dispensing device, including syrup for making beverages like soda.

2. Brief Description of Related Art

The soft drink industry has been using air auto-shut off for Bag-in-Box (BIB) air pump for years. However, there is a problem as flow rate starts to slow down as the BIB is running empty. The cause of the flow to slow down is due to the auto-shut-off mechanism is starting to restrict the incoming air flow as the vacuum starts to build up in the pump suction due to the BIB is about to run out. There is a need in the industry to solve this problem.

SUMMARY OF THE INVENTION

In its broadest sense, the present invention provides a new and unique apparatus or device for turning off a pump, including a pump that is providing syrup to a beverage dispensing device.

The apparatus or device features two chambers, one being a fluid chamber and the other being a gas chamber.

In operation, the fluid chamber is configured to respond to a pressure from the pump and to provide fluid from a container through the fluid chamber to another device, like a beverage dispenser. The fluid chamber is also configured to respond to a vacuum created in the fluid chamber when the container of fluid is substantially empty and to provide a fluid chamber force, which will cause the pump to be turned off.

In operation, the gas chamber is configured to provide gas to the pump for activating the same so as to draw the fluid from the container. The gas chamber is also configured to respond to the fluid chamber force provided by the fluid chamber when the container of fluid is substantially empty, and to stop providing the gas to the pump so as to turn off the pump.

In one particular embodiment, the fluid chamber includes an arrangement having a diaphragm, a piston assembly and a spring arranged therein under compression, where the diaphragm responds to the vacuum pressure and moves the piston assembly so as to provide the fluid chamber force.

In one particular embodiment, the gas chamber includes a triggering mechanism coupled between a spring holder and a valve assembly. The spring holder is configured to respond to the fluid chamber force by moving in one axial direction so as to actuate the triggering mechanism to move the valve assembly in the other direction for stopping the flow of gas being provided to the pump so as to turn the pump off.

In one particular embodiment, the triggering mechanism may include a spring, e.g. a W-shaped spring. The W-shaped spring may be connected to the spring holder and the valve assembly under compression. The gas chamber may also include a spool having a hole for providing the gas from an air input port to the gas chamber. When the W-shaped spring is triggered, the valve assembly blocks the hole so that no gas is provided from the air input port to the gas chamber, thus turning off the pump.

In one particular embodiment, the fluid is syrup that is contained in a bag. In this embodiment, the fluid chamber takes the form of a syrup chamber, and the gas takes the form of air. In operation, when the device is activated there is vacuum pressure in the syrup chamber. A diaphragm acting in response to the vacuum causes a piston assembly in the syrup chamber to move in the one direction (e.g. right), thus compressing the W-shaped spring in the air chamber. As the piston assembly moves, the spring holder also moves to the right. As the W-shaped spring is compressed over and passed the most compressed position, the W-shaped spring moves a valve assembly to the opposite direction (e.g. left) and blocks the hole in the spool, which turns off the gas being supplied to the pump, thus turning off the pump.

The positive air auto-shut off device according to the present invention is developed to solve the problem in the art set forth above by having the air shut off with no restriction until specific vacuum is reached and air is shut off completely with no partial air closure. This saves the $CO_2$ from being exhausted prematurely, e.g., if the pump were to keep running after the syrup bag is empty.

DETAILED DESCRIPTION OF THE INVENTION

Figure 1:
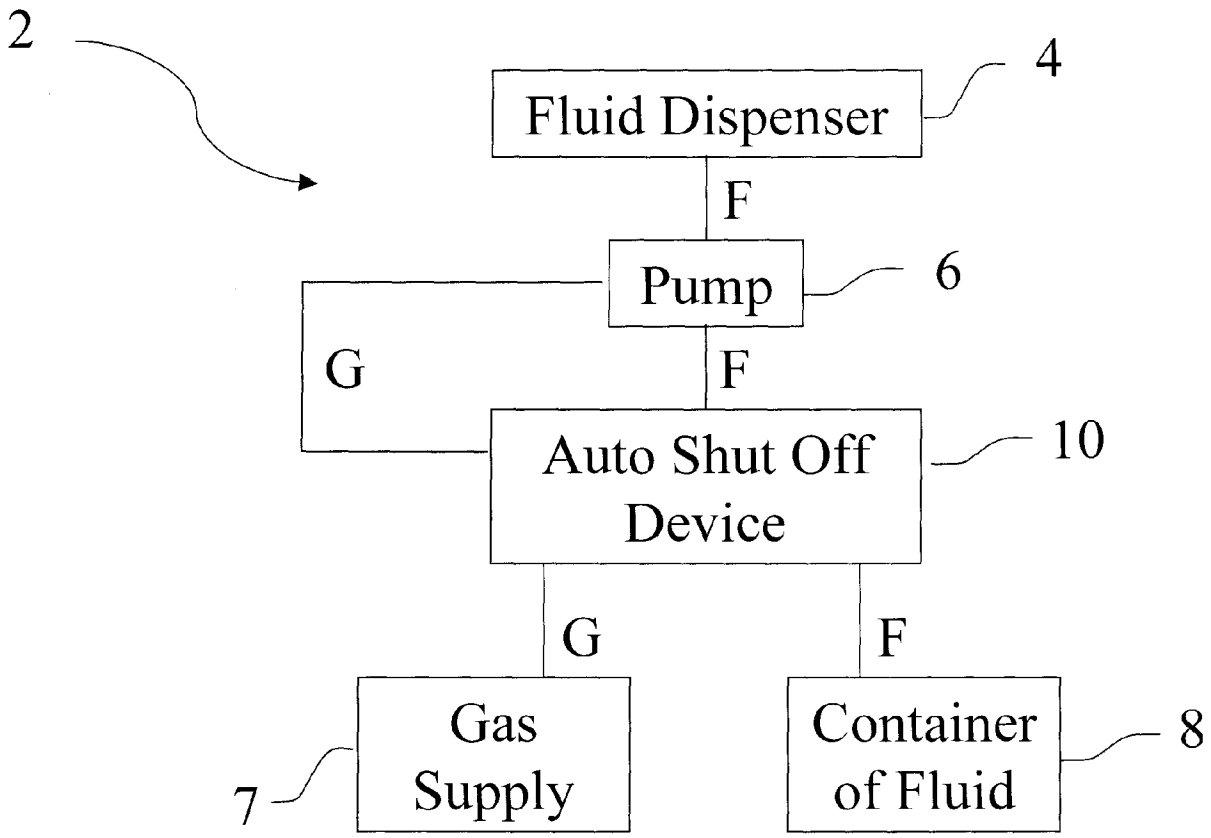
FIG. 1 is a block diagram of a fluid system having an auto shut off device according to some embodiments of the present invention.

FIG. 1 show a system generally indicated as 2 having a fluid dispenser 4, a pump 6, a gas supply 7, a bag or container 8 of fluid and an auto shut-off device 10. In operation, the pump 6 responds to gas from the gas supply 7 and draws the fluid from the bag or container 8 through the auto shut-off device 10, through the pump 6 and to the fluid dispenser 4.

In particular, the present invention relates to features of the auto shut-off device 10, as well as how the auto shut-off device 10 operates to turn the pump 6 on/off when the bag of fluid is empty. The present invention is described, by way of example, in relation to the bag 8 of fluid being syrup, and the fluid dispenser 4 being a beverage dispenser, like a soda dispenser at, e.g. a fast food restaurant, although the scope of the invention is not intended to be limited to the type or kind of fluid, or the type or kind of dispenser to which the fluid is being provided. Moreover, fluid dispensers like element 4, pumps like element 6, gas supplies like element 7 and bags or containers like element 8 of fluid are all known in the art, and the scope of the invention is not intended to be limited to any particular type or kind either now known or later developed in the future.

Figure 2:
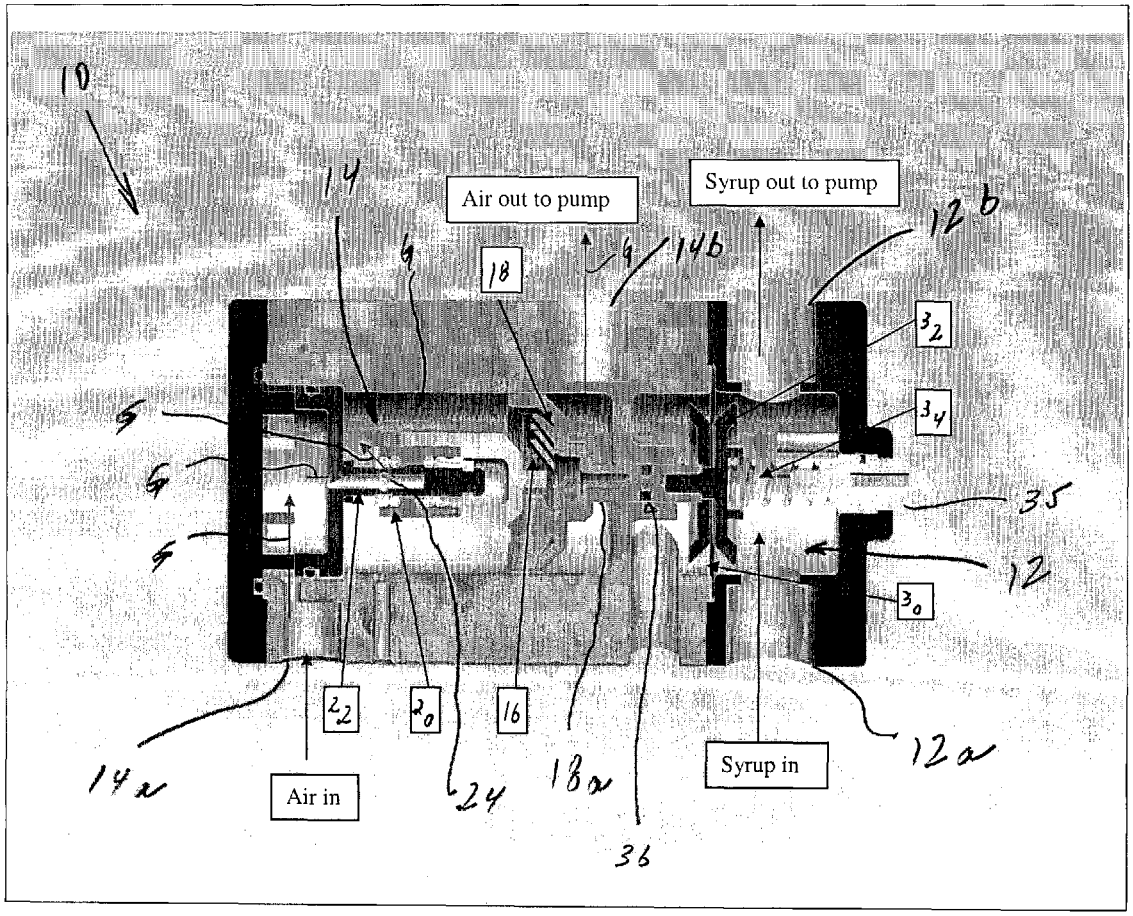
FIG. 2 is a diagram of the auto shut off device in FIG. 1 according to some embodiments of the present invention.

FIG. 2 shows the positive air shut off device 10 is further detail, which includes two chambers, i.e. a syrup chamber 12 and an air chamber 14. The syrup is provided from the bag 8 to the syrup chamber 12 via a syrup input port 12*a*, and the syrup is provided from the syrup chamber 12 to the beverage dispensing device 4 via a syrup output port 12*b*. Similarly, the gas or air is provided to the air chamber 14 via an air input port 14*a*, and the gas or air is provided from the air chamber 14 via an air output port 14*b* to the pump 6.

In operation, the syrup chamber 12 is configured to respond to vacuum pressure indicating that the bag 8 of syrup is substantially empty and to provide an actuation or syrup chamber force for turning off the pump 6 that draws the syrup from the bag 8 through the syrup input port 12*a*. The air chamber 14 has a triggering mechanism 16 configured to be coupled between a spring holder 18 and a valve assembly 20. The spring holder 18 is configured to respond to the actuation or syrup chamber force by moving in one axial direction so as to actuate the triggering mechanism 16 to move the valve assembly 20 in the opposite direction for stopping the flow of gas or air being provided to the pump 6 so as to turn the pump off.

As shown, the triggering mechanism 16 is a spring 16, including a W-shaped spring, which is connected under compression between the spring holder 18 and the valve assembly 20. The gas or air chamber 14 also may include a spool 22 having a hole or aperture 24 formed therein for providing the air from the air input port 14*a* to the air chamber 14. The syrup chamber 12 also includes an arrangement having a diaphragm 30, a piston assembly 32 and a compression spring 34 arranged therein. As shown, the spring holder 18 has a shaft 18*a* with O-ring 36 arranged thereon for cooperating with an inner wall surface of a channel of the device between the two chambers 12 and 14 for sealing the same in relation to one another.

In operation, when the Auto-Shut-Off (ASO) device 10 is activated there is vacuum pressure developed in the syrup chamber 12. In response thereto, the diaphragm 30 responds to the vacuum pressure and causes the piston assembly 32 to move in one direction (e.g. to the right as shown) so as to compress the spring 34. The compression of the spring 34 may be adjustable to suit the application by turning a spring adjustment bolt 35. As the piston assembly 32 moves in the one direction, the spring holder 18 also moves in the same direction, e.g. to the right as shown in FIG. 2. As the W-shaped spring 16 is compressed over and passed the most compressed position by this rightward movement, the W-shaped spring 16 is triggered so as to cause the valve assembly 20 to move in the opposite direction (e.g. to the left as shown) so as to block the hole 24 in the spool 22. This blockage stops the air from flowing into the air chamber 14, thus turning off the pump 6.

As a person skilled in the art would appreciate, the functionality of the triggering of the W-shaped spring 16 is such that once its right leg portion is moved to the right a certain distance in response to the vacuum pressure in the fluid chamber 12, then in further response its corresponding left leg portion will be moved to the left a corresponding distance that is substantially equal to the certain distance the right leg portion moved. As a person skilled in the art would appreciate, this triggering movement of the corresponding left leg portion will cause the valve assembly 20 to move in the opposite direction (e.g. left as shown) so as to block the hole 24 in the spool 22.

Alternative Embodiment

Figure 3:
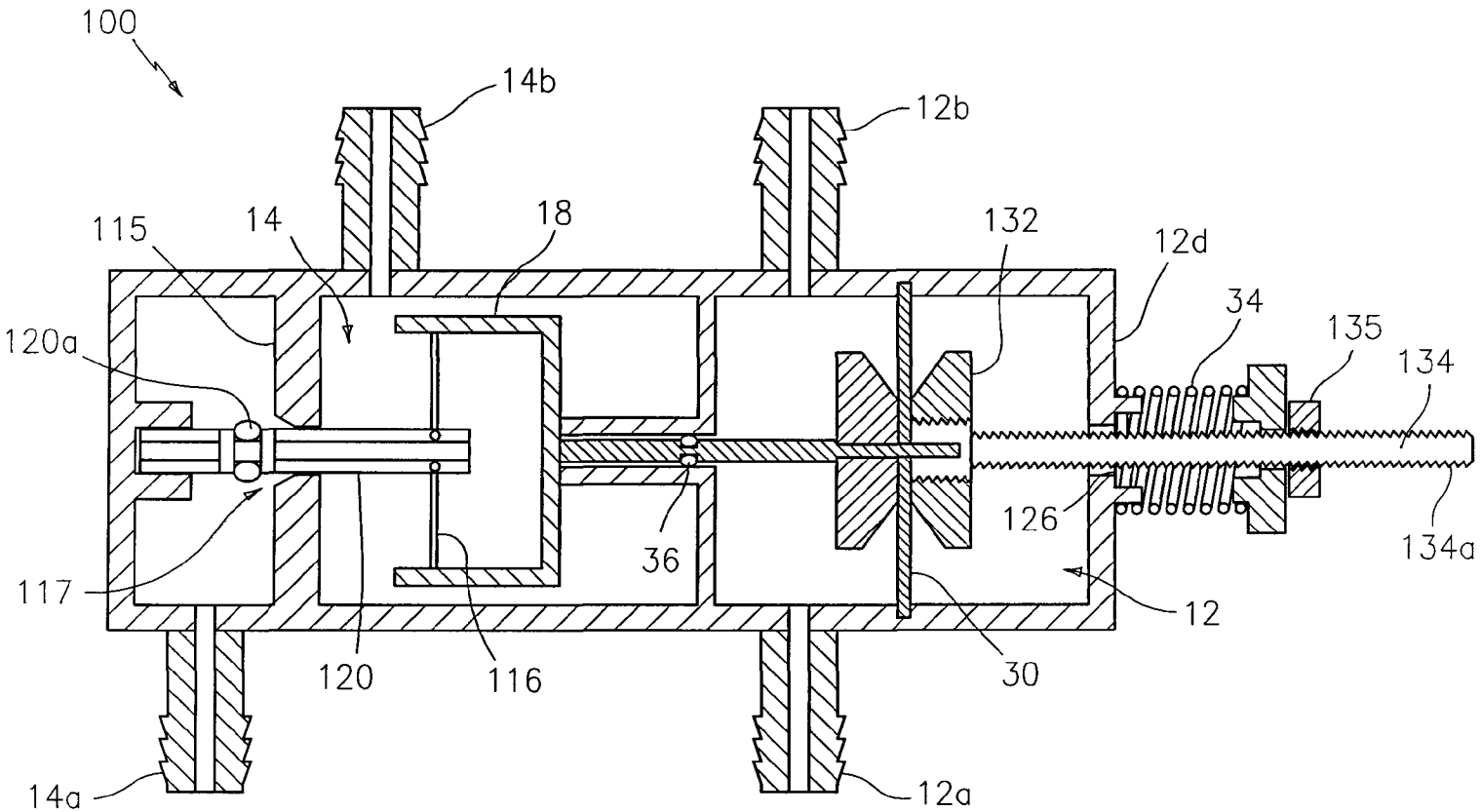
FIG. 3 is a diagram of the auto shut off device in FIG. 1 according to some embodiments of the present invention.

FIG. 3 shows an alternative embodiment of the auto shut off device generally indicated as 100. In FIGS. 2-3, similar features are labeled with similar reference numerals. Moreover, the features and functions of the auto shut off device 100 that are similar to the device 10 in FIG. 2 are not described in detail.

In the auto shut off device 100, an air chamber 114 has an internal wall 115 having an opening 117. The valve assembly 120 has a W-shaped spring 116 and an O-ring 120*a*. In operation, the W-shaped spring 116 is triggered so as to cause the valve assembly 120 to move so that the O-ring 120*a* blocks the opening 117 in the internal wall 115, cutting off the flow of air to the pump 6 via output port 14*b*.

Moreover, in FIG. 3 the compression spring 34 is arranged slightly differently than that shown in FIG. 2. For example, the syrup chamber 12 has a piston assembly 132 having an extension rod 134 with threads 134*a* that passes through an opening 12*c* of an outer wall 12*d* of the syrup chamber 12. The compression spring 34 is arranged between the outer wall 12*c* and a fastening device 135 having corresponding threads (unlabeled) for cooperating with the threads 134*a* of the extension rod 134. Similar to that described above, the compression of the spring 34 may be adjustable to suit the application by turning the fastening 135.

The Scope of the Invention

Further still, the embodiments shown and described in detail herein are provided by way of example only; and the scope of the invention is not intended to be limited to the particular configurations, dimensionalities, and/or design details of these parts or elements included herein, including valves, screws, threads, O-rings, channels, openings or apertures, walls, springs, pistons, diaphragms, etc. In other words, a person skilled in the art would appreciate that design changes to these embodiments may be made and such that the resulting embodiments would be different than the embodiments disclosed herein, but would still be within the overall spirit of the present invention.

It should be understood that, unless stated otherwise herein, any of the features, characteristics, alternatives or modifications described regarding a particular embodiment herein may also be applied, used, or incorporated with any other embodiment described herein. Also, the drawings herein are not drawn to scale.

Although the invention has been described and illustrated with respect to exemplary embodiments thereof, the foregoing and various other additions and omissions may be made therein and thereto without departing from the spirit and scope of the present invention.

What I claim is:

1. Apparatus comprising:

a fluid chamber arranged between a container of fluid and a pump for providing the fluid to another device, the fluid chamber responds to a pressure from the pump and provides the fluid from the container through the fluid chamber to the pump and said another device, and the fluid chamber also includes an arrangement that responds to a vacuum pressure created in the fluid chamber when the container of fluid is substantially empty and provides a fluid chamber force by moving the arrangement so as to cause the pump to turn off; and a gas chamber arranged between a gas supply and the pump, having a spool with an aperture formed therein to receive gas from the gas supply and provide the gas via the aperture through the gas chamber to the pump for activating the same so as to draw and provide the fluid from the container to said another device, the gas chamber also having a valve assembly that responds to the fluid chamber force caused by the movement of the arrangement and moves and closes the aperture of the spool so as to stop providing the gas through the gas chamber to the pump so as to turn the pump off, wherein the gas chamber comprises a spring holder with a triggering mechanism arranged therein, the triggering mechanism is coupled between the spring holder and the valve assembly, the spring holder responds to the fluid chamber force by moving in one axial direction so as to actuate the triggering mechanism to move the valve assembly in an opposite direction for stopping the flow of gas or air via the aperture being provided to the pump so as to turn the pump off.

2. The apparatus according to claim 1, wherein the triggering mechanism comprises a spring that is connected under compression between the spring holder and the valve assembly.

3. The apparatus according to claim 2, wherein the spring comprises a W-shaped spring.

4. The apparatus according to claim 3, wherein the arrangement comprises a piston assembly that is coupled to the spring holder so that when the piston assembly moves in the one direction, the spring holder also moves in the same direction.

5. The apparatus according to claim 4, wherein when the W-shaped spring is compressed over and passed a most compressed position by the movement of the piston assembly and the spring holder, the W-shaped spring triggers to cause the valve assembly to move in the opposite direction so as to block the aperture in the spool, where the blockage stops the gas from flowing into the gas chamber, thus turning off the pump.

6. The apparatus according to claim 1, wherein the spool having the aperture formed therein to provide the gas from a gas input port to the gas chamber.

7. The apparatus according to claim 6, wherein the spring holder comprises a shaft with an O-ring arranged thereon for cooperating with an inner wall surface of a channel of the apparatus between the fluid chamber and the gas chamber for sealing the same in relation to one another.

8. The apparatus according to claim 1, wherein the arrangement comprises a diaphragm, a piston assembly and a spring, the diaphragm being coupled to the piston assembly, the diaphragm responding to the vacuum pressure and causing the piston assembly to move in the one direction so as to compress the spring against a wall of the fluid chamber.

9. The apparatus according to claim 8, wherein the compression of the spring is adjustable to suit a particular application by turning a spring adjustment bolt.

10. The apparatus according to claim 8, wherein the piston assembly has one end with the diaphragm arranged in the fluid chamber that responds to the vacuum pressure so as to move the piston assembly; and wherein the piston assembly has an opposite end coupled to the spring holder arranged in the gas chamber.

11. The apparatus according to claim 10, wherein the spring comprises a W-shaped spring.

12. The apparatus according to claim 11, wherein when the W-shaped spring is compressed over and passed a most compressed position by the movement of the piston assembly and the spring holder, the W-shaped spring triggers to cause the valve assembly to move in the opposite direction so as to block the aperture in the spool, so that the blockage stops the gas from flowing into the gas chamber, turning off the pump.

13. The apparatus according to claim 1, wherein the fluid chamber is a syrup chamber that responds to the vacuum pressure indicating that a bag of syrup is substantially empty, for providing the fluid chamber force for turning off the pump that draws syrup from the bag.

* * * * *